United States Patent [19]

Ichikawa

[11] Patent Number: 4,892,086

[45] Date of Patent: Jan. 9, 1990

[54] INTERNAL COMBUSTION TYPE IRON

[76] Inventor: Masaharu Ichikawa, 44-11, Matsubara 1-chome, Setagayaku, Tokyo, Japan

[21] Appl. No.: 293,751

[22] Filed: Jan. 3, 1989

[30] Foreign Application Priority Data

Jan. 11, 1988 [JP] Japan ..... 63-1824[U]

[51] Int. Cl.[4] ..... A45D 1/02

[52] U.S. Cl. ..... 126/409; 126/408; 431/344

[58] Field of Search ..... 126/408, 409, 414; 431/344, 347, 345

[56] References Cited

U.S. PATENT DOCUMENTS

| | | | |
|---|---|---|---|
| 3,574,506 | 4/1971 | Locke | 431/344 |
| 3,612,037 | 10/1971 | Spiggle | 431/344 |
| 4,321,934 | 3/1982 | Diederich | 126/408 |
| 4,502,465 | 3/1985 | Yoshinaga et al. | 126/409 |
| 4,539,974 | 9/1985 | Tittert | 126/409 |
| 4,666,399 | 5/1987 | Nelson | 431/344 |
| 4,759,343 | 7/1988 | Schawbel et al. | 126/409 |

*Primary Examiner*—Ira S. Lazarus
*Assistant Examiner*—Christopher Hayes
*Attorney, Agent, or Firm*—Collard, Roe & Galgano

[57] ABSTRACT

An internal-combustion type iron has a nozzle provided in a grip portion so as to spray a jet of gas supplied from a liquified-gas tank into a hollow barrel. The hollow barrel has a base portion fitted to the grip portion and communicating with the nozzle. An air hole is provided in the base portion of the barrel so that the outside air may be sucked into and be mixed with the gas from the nozzle. A gas flow control body is disposed in the center of a hollow portion of the barrel generates a stagnant vortex flow in the flow of the mixture of the gas and air. A mixing chamber is provided in the hollow portion of the barrel between the air hole and the gas flow control body. The mixing chamber has a length sufficient for the required mixing of the gas with air and for stabilization of flow velocity. A heating chamber is provided in the hollow portion of the barrel between the gas flow control body and an exhaust port provided at the tip of the barrel. The heating chamber has a length sufficient for the required heating of the barrel by the combustion gas. The stagnant vortex flow of the gas mixture is generated at a predetermined distance from the nozzle by the gas flow control body and is ignited with the flame being maintained at this point.

4 Claims, 2 Drawing Sheets

INTERNAL COMBUSTION TYPE IRON

BACKGROUND OF THE INVENTION

1. Field of the Invention

This invention relates to an internal-combustion type iron in which a gas supplied from a liquified-gas tank is burned in a barrel, and the invention is suitably applicable to a curling iron, a hair roller, a soldering iron, an iron for clothes, or the like.

2. Description of the Prior Art

Curling irons have been known in which a gas supplied from a liquified-gas tank is burned in a barrel. In this type of curling iron, a burner for burning the gas is disposed in the barrel, and the diameter of the burner is determined according to the quantity of gas required for a predetermined heat generation. There is therefore a limit to the possible reduction of the diameter of the burner and, accordingly, there are difficulties in decreasing the diameter of the barrel in which the burner is enclosed. Thus, it has been impossible to achieve fine hair curling with such a curling iron.

SUMMARY OF THE INVENTION

It is an object of this invention to provide an internal-combustion type iron which makes it possible to reduce the diameter of a barrel.

It is a further object to provide an internal combustion type iron which is simple in design, economical to manufacture, and which includes an enhanced flame control system.

Accordingly, these and related objects are achieved by the present invention by providing a liquified-gas tank and a nozzle for jetting a gas supplied from the tank in a grip portion. In addition, a base portion of a hollow barrel communicating with the nozzle is attached to the grip portion. The base portion of the barrel is provided with an air hole for taking in the outside air, whereas an exhaust port is provided at a tip portion of the barrel. A gas flow control body for generating a stagnant vortex flow in a flow of a gaseous mixture of the gas with air is disposed in the center of a hollow portion of the barrel. The hollow portion of the barrel, which is located between the air hole and the gas flow control body, is formed as a mixing chamber having a length sufficient for the required mixing of the gas with air and for the stabilization of flow rate. The hollow portion of the barrel between the gas flow control body and the exhaust port is formed as a heating chamber having a length required for heating of the barrel by a combustion gas. In the internal-combustion type iron according to the present invention, a stagnant vortex flow is generated at a distance from the nozzle by the gas flow control body, and is ignited; therefore, it is possible to reduce the diameter of the barrel.

These and other objects and advantages of the present invention will become apparent from the following description of the accompanying drawings, which disclose several embodiments of the invention. It is to be understood that the drawings are to be used for purposes of illustration only, and not as a definition of the invention.

BRIEF DESCRIPTION OF THE DRAWINGS

Further advantages and details can be gleaned from the drawings wherein similar reference numerals denote similar elements throughout the several views.

DESCRIPTION OF THE PREFERRED EMBODIMENTS

Figure 1:
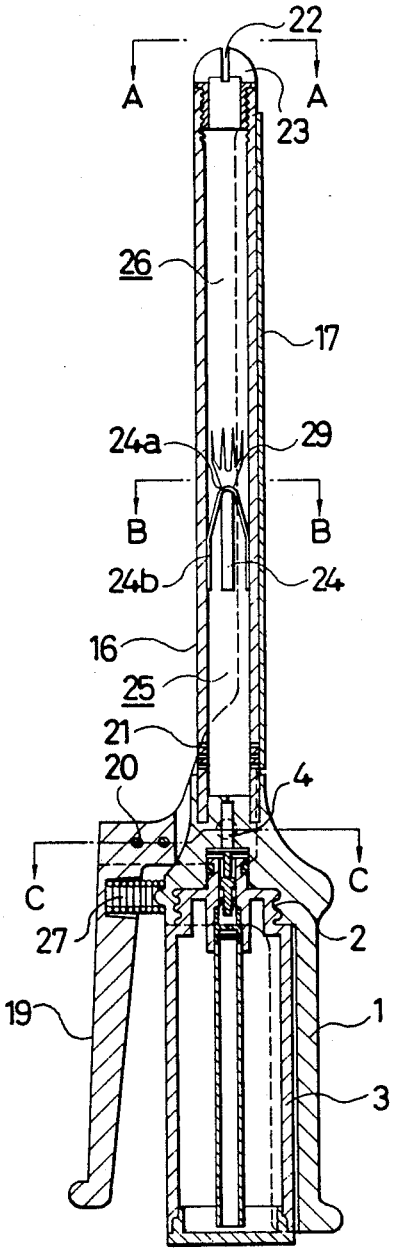
FIG. 1 is a cross-sectional view showing a first embodiment of the present invention.
Figure 2A:
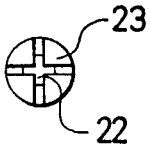
FIG. 2A is a cross-sectional view taken along line A—A of FIG. 1.
Figure 2B:
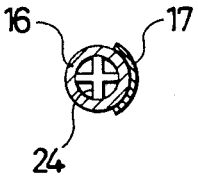
FIG. 2B is a cross-sectional view taken along line B—B of FIG. 1.
Figure 2C:
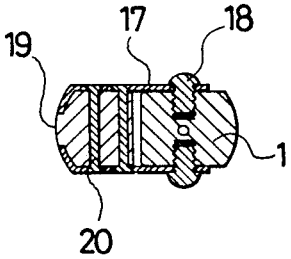
FIG. 2C is a cross-sectional view taken along line C—C of FIG. 1.
Figure 3:
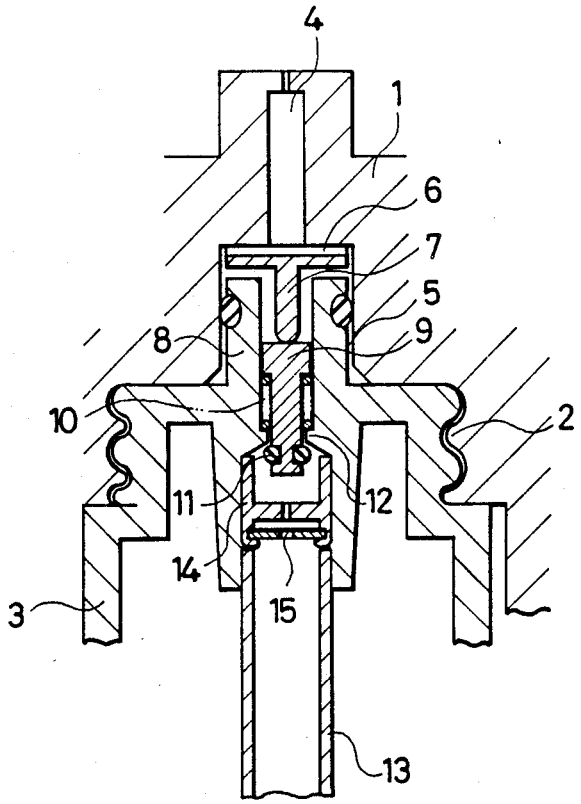
FIG. 3 is an enlarged cross-sectional view showing the connection between the liquified-gas tank and the nozzle of FIG. 1.

Referring to FIGS. 1 to 3, there is shown one embodiment of the invention, wih the invention being applied to a curling iron for purposes of illustration only. A cartridge type liquified-gas tank 3 is detachably screwed into a threaded portion 2 of a grip portion 1. The grip portion 1 is provided with a nozzle 4 for jetting a gas supplied from tank 3. The connection between tank 3 and nozzle 4 is shown in detail in FIG. 3. A connecting chamber 5, communicating with nozzle 4, contains therein a valve-opening pin 7 having a vent groove 6. When liquified-gas tank 3 is screwed into threaded portion 2 of grip portion 1, a projecting portion 8 is inserted into connecting chamber 5. Valve-opening pin 7 then pushes a valve body 9 downwardly against a valve spring 10, thereby separating a seal member 11 from a valve seat 12. With the valve thus opened, the gas is sucked up through a suction pipe 13 and permitted to pass through a filter device 14 and is then supplied to nozzle 4, from which the gas is jetted. Filter device 14 comprises a microporous film 15, for instance, a uniaxially stretched microporous polypropylene film, and permits only the evaported gas to penetrate the film in a constant fixed quantity.

A base portion of a barrel 16 is mounted on grip portion 1, and a clip 17, capable of being laid over the barrel 16, is rotatably fitted to grip portion 1 by a screw 18 (see FIG. 2C). A base portion of the clip 17 is connected to a clip lever 19 by a pin 20. The base portion of barrel 16 is provided with an air hole 21 for introducing the outside air, whereas an end cap 23, having an exhaust port 22, is screwed into a tip portion of barrel 16.

Figure 4:
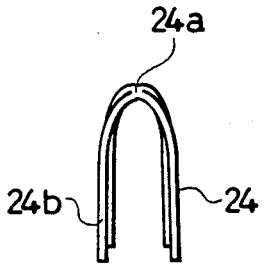
FIG. 4 is an enlarged perspective view of the gas flow control body according to the embodiment of FIG. 1.
Figure 5:
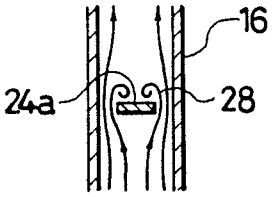
FIG. 5 is a cross-sectional view showing the stagnant vortex flow condition generated with the flow control body of FIG. 4; and, FIG. 6 is a cross-sectional view showing a second embodiment of the gas flow control body.

Referring to FIGS. 4 and 5, there is shown a gas flow control body 24 disposed substantially to the center of hollow barrel 16. Gas flow control body 24 generates a stagnant vortex flow 28 in the flow of the gas and air mixture. A first embodiment of gas flow control body 24 is shown in detail in FIG. 4. Gas flow control body 24 comprises a stagnant vortex flow generator portion 24*a*, oriented substantially perpendicular to the flow of the gaseous mixture, and a support portion 24*b* making frictional contact with the inner wall of barrel 16. A mixing chamber 25 is formed within the hollow portion of barrel 16 between air hole 21 and flow control body 24. Mixing chamber 25 is designed to have a length sufficient for the required mixing of the gas with air and for the stabilization of flow velocity. A heating chamber 26 is formed by the hollow portion of barrel 16 between flow control body 24 and exhaust port 22, and is designed to have a length sufficient for the required heating of barrel 16 by the combustion of the gas mixture (namely, for cooling the exhaust gas). Numeral 27 denotes a clip lever spring.

Figure 6:
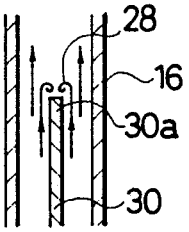

Referring to FIG. 6, there is shown a second embodiment of the gas flow control body. A flow control body 30, in a slender cylindrical form, is disposed in the center of barrel 16, and is supported by a support member (not shown). A tip portion of flow control body 30 has a horizontal end face which constitutes a stagnant vortex flow generator portion 30a. When the flow of the gaseous mixture reaches portion 30a, stagnant vortex flow 28 is generated along the end face. In this embodiment, it is possible to make the flow control body 30 serve also as a discharge electrode for the ignition of the gas mixture.

The operation of the curling iron according to the first embodiment of the invention will now be explained. In mixing chamber 25, the gas jetted from nozzle 4 is mixed sufficiently with the outside air introduced through air hole 21. The resultant gaseous mixture flows at a stable flow velocity to gas flow control body 24. The flow of the gaseous mixture generates stagnant vortex flow 28 at stagnant vortex flow generator portion 24a of flow control body 24, as shown in FIG. 5. In this condition, ignition at exhaust port 22 causes a flame to go upstream to stagnant vortex flow 28, where the flame is stabilized at the position of flame 29 shown in FIG. 1. The flow velocity of the gaseous mixture is so high that the flame will not go further upstream from the position of flame 29.

The flame 29 and the exhaust gas produced, heat heating chamber 26 of barrel 16 and the entire body of barrel 16 is heated through the conduction of the heat generated. The exhaust gas is discharged through the exhaust port 22. The temperature of the exhaust gas thus discharged must be low enough so that the user will not get burned, and accordingly, the heating chamber 26 is designed to have the required length to provide adequate heat absorption.

The user then, by operating the clip lever 19, winds the hair around the barrel 16 and fix the hair by the clip 17, thereby curling the hair.

When it is desired to stop the combustion of the gas, the engagement of liquified-gas tank 3 in threaded portion 2 is untightened, whereby valve body 9 is released from the push-down position by valve-opening pin 7. Seal member 11 is then brought into contact with valve seat 12. Thus, the valve is closed, and the jetting of the gas from nozzle 4 is stopped. It is, therefore, possible to reduce the inside diameter of the barrel to a value equal to the inside diameter of a burner used in the prior art. Accordingly, it is possible to achieve fine hair curling.

It should be noted that the shape of the gas flow control body is not limited to that shown in FIGS. 4 or 6. For instance, a body of round wire rods in a crossed form may be used. Also, the liquified-gas tank may be one which is permanently fixed to grip portion 1 and has an injection valve for replenishment with a liquified gas. In addition, this invention is applicable not only to curling irons but to hair rollers, soldering irons, irons for clothes, and the like.

While only two of the embodiments and examples of the present invention have been illustrated and described, it is obvious that many changes and modifications may be made thereunto, without departing from the spirit and scope of the invention.

What is claimed is:

1. An internal-combustion type iron comprising:
a grip portion;
a liquified-gas tank attached to said grip portion;
a nozzle located in the grip portion in selective communication with said liquified-gas tank for jetting a gas supplied from the liquified-gas tank;
a hollow barrel having a base portion attached to said grip portion, the barrel interior communicating with this outflow of said nozzle;
an air hole provided in the base portion of the barrel allowing the inflow of outside air for forming a gaseous mixture of said air and said gas;
an exhaust port provided at a tip portion of the barrel;
a gas flow control body disposed within the hollow portion of said hollow barrel, comprising a stagnant vortex flow generator portion which is centered within said hollow portion, and perpendicular to the flow of the gaseous mixture for generating a stagnant vortex flow along a surface of the downstream side of said stagnant vortex flow generator portion wherein a flame commences at the stagnant vortex flow generator such that the gaseous mixture lies close to the barrel and thereby heats the barrel efficiently along the entire length thereof;
a mixing chamber located in the hollow portion of the barrel between said air hole and said gas flow control body, the mixing chamber having a length permitting the required mixing of said gas with said air and for stablization of flow velocity; and,
a heating chamber provided in the hollow portion of the barrel between said gas flow control body and said exhaust port, the heating chamber having a length sufficient for heating of the barrel by a combustion gas.

2. The internal-combustion type iron, as set forth in claim 1, wherein the liquified-gas tank is removably attached to said grip portion.

3. The internal-combustion type iron, as set forth in claim 1, wherein said gas flow control body further comprises a support portion in frictional engagement with the inner wall of the barrel.

4. A curling iron of the type comprising:
a grip portion;
a liquified-gas tank attached to said grip portion;
a nozzle located in the grip portion in selective communication with said liquified-gas tank for jetting a gas supplied from the liquified-gas tank;
a hollow barrel having a base portion attached to said grip portion, the barrel interior communicating with this outflow of said nozzle;
an air hole provided in the base portion of the barrel allowing the inflow of outside air for forming a gaseous mixture of said air and said gas;
an exhaust port provided at a tip portion of the barrel;
a gas flow control body disposed within the hollow portion of said hollow barrel, comprising a stagnant vortex flow generator portion which is centered within said hollow portion, and perpendicular to the flow of the gaseous mixture for generating a stagnant vortex flow along a surface of the downstream side of said stagnant vortex flow generator portion wherein a flame commences at the stagnant vortex flow generator such that the gaseous mixture lies close to the barrel and thereby heats the barrel efficiently along the entire length thereof;

a mixing chamber located in the hollow portion of the barrel between said air hole and said gas flow control body, the mixing chamber having a length permitting the required mixing of said gas with said air and for stabilization of flow velocity;

a heating chamber provided in the hollow portion of the barrel between said gas flow control body and said exhaust port, the heating chamber having a length sufficient for heating of the barrel by a combustion gas; and, a clip pivotably mounted to an outer surface of said hollow barrel for pivotal movement toward and away therefrom.

* * * * *